US006518833B2

(12) United States Patent
Narendra et al.

(10) Patent No.: US 6,518,833 B2
(45) **Date of Patent: *Feb. 11, 2003**

(54) LOW VOLTAGE PVT INSENSITIVE MOSFET BASED VOLTAGE REFERENCE CIRCUIT

(75) Inventors: Siva G. Narendra, Beaverton, OR (US); Krishnamurthy Soumyanath, Portland, OR (US); Vivek K. De, Beaverton, OR (US)

(73) Assignee: Intel Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/470,275

(22) Filed: Dec. 22, 1999

(65) Prior Publication Data

US 2002/0027470 A1 Mar. 7, 2002

(51) Int. Cl.[7] ..... G05F 1/10
(52) U.S. Cl. ..... 327/541; 323/315; 327/543
(58) Field of Search ..... 327/539, 540, 327/541, 543; 323/313, 315

(56) References Cited

U.S. PATENT DOCUMENTS

| | | | | | |
|---|---|---|---|---|---|
| 5,257,039 | A | * | 10/1993 | Chung et al. | 323/315 |
| 5,481,179 | A | * | 1/1996 | Keeth | 323/315 |
| 5,559,425 | A | * | 9/1996 | Allman | 323/315 |
| 5,627,456 | A | * | 5/1997 | Novof et al. | 323/315 |
| 5,684,394 | A | * | 11/1997 | Marshall | 323/315 |
| 5,900,773 | A | * | 5/1999 | Susak | 323/313 |
| 6,002,243 | A | * | 12/1999 | Marshall | 323/313 |
| 6,037,762 | A | * | 3/2000 | Koelling et al. | 323/313 |
| 6,177,788 | B1 | * | 1/2001 | Narendra et al. | 323/315 |
| 6,188,270 | B1 | * | 2/2001 | Boerstler | 327/543 |
| 6,198,312 | B1 | * | 3/2001 | Floyd | 327/77 |
| 6,271,706 | B1 | * | 8/2001 | Nair | 327/311 |

* cited by examiner

*Primary Examiner*—Terry D. Cunningham
(74) *Attorney, Agent, or Firm*—Schwegman, Lundberg, Woessner & Kluth, P.A.

(57) ABSTRACT

Methods and apparatus for generating a MOSFET based voltage reference circuit with automatic trimming of resistors to compensate for process and supply voltage variations and to improve the accuracy of a MOSFET based reference voltage circuit, a temperature compensated MOSFET based reference voltage, and arbitrary translation of the MOSFET based reference voltage with or without trimming are provided.

23 Claims, 4 Drawing Sheets

LOW VOLTAGE PVT INSENSITIVE MOSFET BASED VOLTAGE REFERENCE CIRCUIT

FIELD

The present invention relates generally to field effect transistor (FET) reference voltage circuits, and more specifically to process, supply voltage, and temperature (PVT) compensation in FET voltage reference circuits.

BACKGROUND

Voltage reference circuits that are process, supply voltage, and temperature (PVT) independent have numerous applications. Applications for which PVT independent voltage reference circuits are used include for example forward body bias and analog to digital conversion, as well as any circuits which require accurate supply voltages over a wide range of operating and device conditions.

Conventional voltage reference circuits requiring PVT independence have traditionally used diode or bipolar junction transistor (BJT) bandgap reference circuits. Circuits such as these typically require a supply voltage of at least 1.3 volts. As technology improves, and components become smaller, the supply voltage ($V_{cc}$) for processors continues to drop. Some current processor are operating with supply voltages of 1.4 volts. This is close to the limit at which diode or BJT bandgap circuits will become ineffective for use as supply voltages.

As processor supply voltages drop, exploration has begun for the use of different technologies to provide lower supply voltages. Metal oxide semiconductor field effect transistors (MOSFETs) in their subthreshold operation have been used to generate bandgap like reference voltages. However, the use of MOSFETs in such voltage reference circuits do not generally offer good process variation independence for the reference voltage. Process variations can lead to potentially large fluctuations in supply voltage.

Transistors such as BJTs and MOSFETs have linear and non-linear dependencies that occur based on a number of factors. Those factors include temperature, process, and supply voltage. If the process changes, the output voltage of the circuit and the way the circuit operates will change. Reasons for the change in output voltage include changes due to devices in the circuit, and changes due to temperature. The impact of change in device behavior on the reference voltage is primarily linear in nature. Changes due to temperature typically include linear and non-linear changes.

Because of the availability of MOSFET devices to operate at voltages less than typical BJT bandgap voltages, and due to the decreasing supply voltages for integrated circuits and especially processors, there is a need in the art for compensation of MOSFET reference voltage circuits due to changes in device behavior.

SUMMARY

In one embodiment, a method for providing a MOSFET based reference voltage includes generating a VPTAT with two MOSFETS of different sizes and a first resistance, and generating a reference voltage with a third MOSFET and a second resistance.

In other embodiments, the generated reference voltage is scaled with a scaling circuit to provide arbitrary reference voltages, or the resistances in the reference voltage circuit are automatically adjusted to compensate for changes in device behavior.

In another embodiment, an apparatus for trimming a reference voltage includes a trimming circuit to generate a first voltage, a reference bias generation circuit to generate a second voltage, and a voltage comparator operatively electrically connected to the trimming circuit and to the reference bias generation circuit to compare the first and the second voltages and to generate a plurality of bits to adjust a variable resistance for the reference voltage.

Other embodiments are described and claimed.

DESCRIPTION OF EMBODIMENTS

In the following detailed description of embodiments, reference is made to the accompanying drawings which form a part hereof, and in which are shown by way of illustration specific embodiments in which the invention may be practiced. These embodiments are described in sufficient detail to enable those skilled in the art to practice the invention, and it is to be understood that other embodiments may be utilized and logical, structural, electrical, and other changes may be made without departing from the scope of the present invention.

Figure 1:
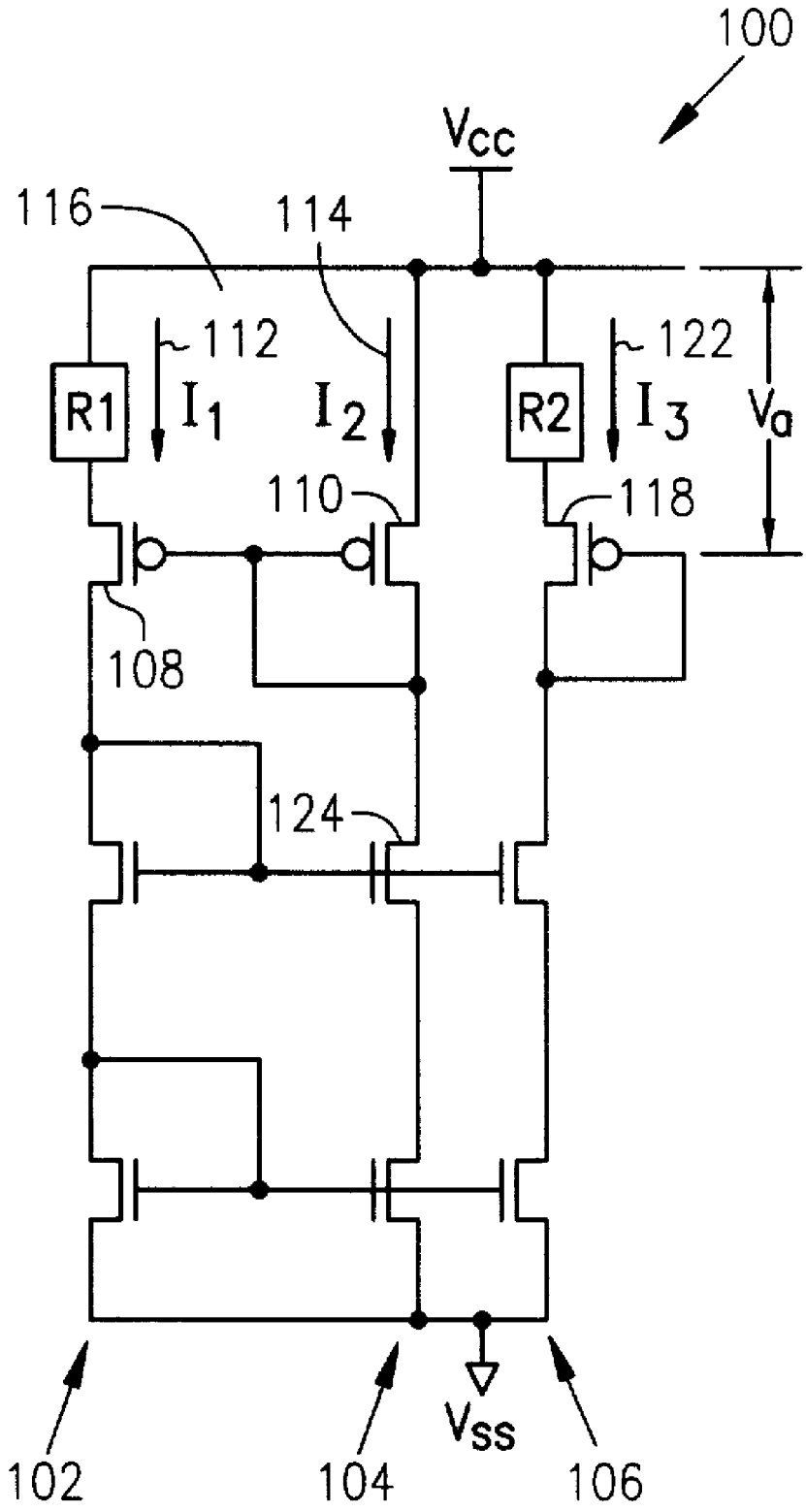
FIG. 1 is a circuit diagram of an embodiment of the present invention.

FIG. 1 shows an embodiment 100 of a circuit that creates a MOSFET based voltage reference source. The circuit 100 comprises in one embodiment three limbs 102, 104, and 106 connected between a supply voltage $V_{cc}$ and a ground voltage $V_{ss}$. Each limb 102 and 104 has a P-type MOSFET 108 and 110, respectively. The P-type MOSFETs operate in this embodiment in the subthreshold region. A pair of N-type MOSFETs in each of the limbs 102 and 104 are used in this embodiment to generate a current I1 indicated by arrow 112 and a current I2 indicated by arrow 114. Resistor R1 is connected in limb 102 between supply voltage $V_{cc}$ and the source of transistor 108.

The circuit 100 performs a linear temperature correction. The gate to source voltage of transistor 108, $V_{gs1}$, is defined, excluding non-linear terms, as:

$$V_{gs1}=V_{t0}-kT$$

where $V_{t0}$ is the threshold voltage, and k is a constant.

In order to allow for compensation, a difference between the gate to source voltages of transistors 108 and 110 is required. This is obtained in one embodiment by the circuit 100 as follows. Transistor 108 is connected as a diode, and has a gate to source voltage $V_{gs1}$, which is an effective diode voltage. Transistor 110 has a gate to source voltage $V_{gs2}$, which is also an effective diode voltage. The NMOS transistors in each of the limbs 102 and 104 effectively push the current I1 and I2 through the respective limbs. In this embodiment, the NMOS devices in limbs 102 and 104 are all identical, and therefore the currents I1 and I2 are identical. The NMOS devices in this embodiment are chosen to ensure that the PMOS devices 108 and 110 operate in the subthreshold region. Current I1 is chosen by the NMOSFETs in limb 102, and not by the resistor 116. This is accomplished by making the value of resistor R1, at a temperature of choice, as follows:

$$R1=(V_{gs1}-V_{gs2})/I1,$$

and the voltage across the resistor R1 is a voltage proportional to absolute temperature (VPTAT).

If the transistors 108 and 110 of different size W108 and W110 have currents I1 and I2, then the voltage across resistor R1, $V_{R1}$, will be a VPTAT given by the formula:

$$VPTAT=V_{R1}=V_{gs2}-V_{gs1}=k[ln(I1/I2)+ln(W1W2)]T,$$

where k is a MOSFET related constant and T is temperature. When the currents I1 and I2 are the same, as in this embodiment, then:

$$V_{R1}=k_aT,$$

where $k_a$=k [ln (W1/W2)], which is still a MOSFET related constant. In one embodiment, transistor size W108 is twice that of size W110.

The voltages in the loop indicated by reference numeral are determined by Kirchhoff's Voltage Law (KVL) as follows:

$$V_{R1}=V_{gs2}-V_{gs1},$$

which is a VPTAT. Therefore, VR1/R1=I1=I2=VPTAT/R1=aT/R1, where a is a constant. I1 and I2 are therefore currents proportional to absolute temperature (IPTAT).

The drain to source voltage $V_{ds}$ in the saturation region of MOSFETs is nearly constant, with only a small slope. In this embodiment, choosing gate to source and drain voltages so as to operate the MOSFETs in the saturation region allows the current to remain nearly constant despite changes in the drain voltage. If the process changes, the currents will change slightly, because of the small slope of the current in the saturation region of the MOSFETS.

To generate a reference voltage $V_a$, the third limb 106 of the circuit 100 includes P-type MOSFET 118, which in one embodiment is sized identically to transistor 110. The NMOS transistors in limb 106 are sized identically to those in limbs 102 and 104, and therefore the current I3 indicated by arrow 122 is identical to currents I1 and I2, namely VPTAT/R1. There is a voltage drop across resistor R2, $V_{R2}$ as follows:

$$V_{R2}=VPTAT\ (R2/R1)$$

The gate to source voltage of transistor 118 is $V_{gs3}$, which is identical to $V_{gs2}$ when transistors 110 and 118 are identical, as in this embodiment. Therefore, $V_a$ is determined to be:

$$V_a=V_{gs3}+VR2=V_{gs3}+VPTAT\ (R2/R1),$$

which, since transistors 118 and 110 are identical, yields:

$$V_a=V_{gs2}+VPTAT\ (R2/R1).$$

Since transistor 118 is in the subthreshold region, the temperature coefficient of $V_{gs3}$ is negative. Therefore, the ratio of resistors, R2/R1 and the current I1=I2=I3=I are chosen to make $V_a$ insensitive of any linear temperature variation. This is accomplished in one embodiment by setting:

$$R2/R1=k_a$$

to obtain a reference voltage.

In another embodiment, resistor R2 is introduced between transistor 110 and NMOSFET 124, in which case $V_{a1}$ is determined as follows:

$$V_{a1}=V_{gs2}+aT,$$

where a is a constant as described above. $V_{a1}$ is also insensitive of any linear temperature variation.

The choice of placement of resistor R2 as shown in FIG. 1 allows all the resistors to be replaced in one embodiment by the same polarity PMOSFET to maintain temperature independence. In this embodiment, the resistors are implemented as parallel binary weighted PMOSFETs operating in the linear region. In another embodiment, the resistors are implemented as parallel binary weighted resistors with PMOS switches to select the total resistor value.

Figure 2:
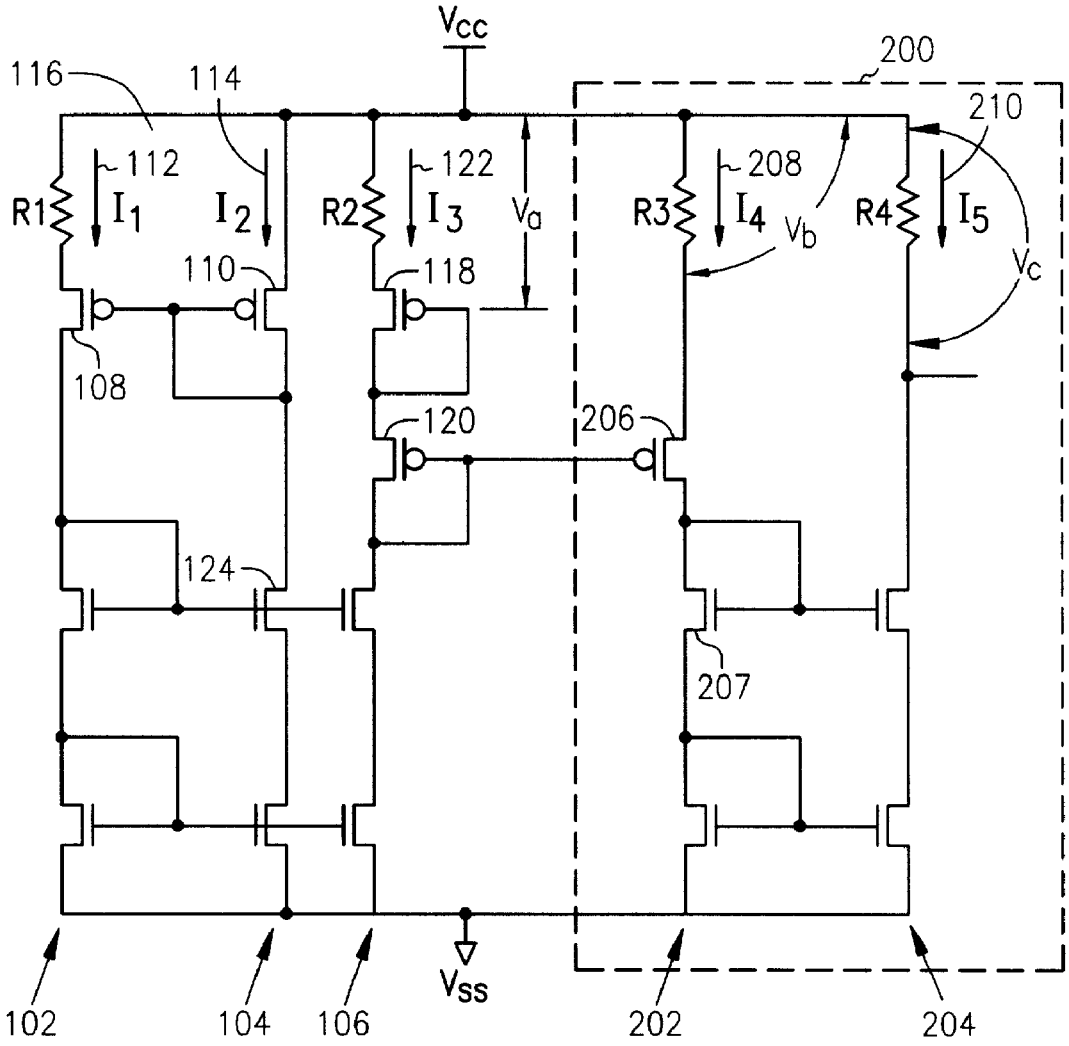
FIG. 2 is a circuit diagram of another embodiment of the present invention.

The voltage $V_a$ generated by the circuit 100 is unscaled. That is, its value is not flexible. $V_a$ is insensitive of linear temperature variation, that is it is temperature compensated. In another embodiment 200 shown in FIG. 2, a scaling circuit for reference voltage $V_a$ is shown. Scaling circuit 200 comprises limbs 202 and 204. Limb 202 includes a resistor R3, a P-type MOSFET 206, and diode connected NMOSFET devices, including NMOSFET 207, to generate a current I4. Limb 204 includes a resistor R4 and diode connected NMOSFET devices identical to the NMOSFET devices of limb 202. In one embodiment, transistors 120 and 206 are identical. Under this condition, the voltages $V_{gs4}$ and $V_{gs5}$, across transistors 120 and 206 respectively, are equal. Again using KVL:

$$V_{R3}=V_{R2}+V_{gs3}+V_{gs4}-V_{gs5}.$$

Since $V_{gs4}=Vgs5$, $$V_{R3}=V_{R2}+V_{gs3}=V_b, \text{ and}$$

since $V_{a=Vgs3+VR2}$, $$V_b=V_a.$$

The current I4 across R3 is $V_a$/R3. This same current is mirrored across R4 as current I5. The voltage $V_{R4}$ across resistor R4 is:

$$V_{R4}=V_a/R3=V_b/R3=V_c, \text{ and}$$

$$V_c=V_a\ (R4/R3).$$

Choosing the ratio of R4/R3 allows the choice of reference voltage $V_c$, which is insensitive of linear temperature variation and scaled. It should be seen that the choice of the ratio R4/R3 allows potentially arbitrary supply voltages less than $V_{cc}$ as reference values.

The current I1 is originally set by the NMOSFETs of limb 102 without any resistor R1 present. This is accomplished in one embodiment by setting:

$$R1=(V_{gs2}-V_{gs1})/$$

at a particular temperature within the range of interest.

In one embodiment, resistor R1 is not a conventional resistor. It is either a part of the transistor 108 or a MOSFET device itself. Thus, when resistance R1 is added to the limb 102. if the system process changes, the resistance R1 changes. This is undesirable because circuit behavior will be affected by the resistance change. As long as the ratios of the resistances in the circuit remain the same, individual resistance changes will be slight. However, since the resistances change, the ratios will typically also change, even if slightly.

Figure 3:
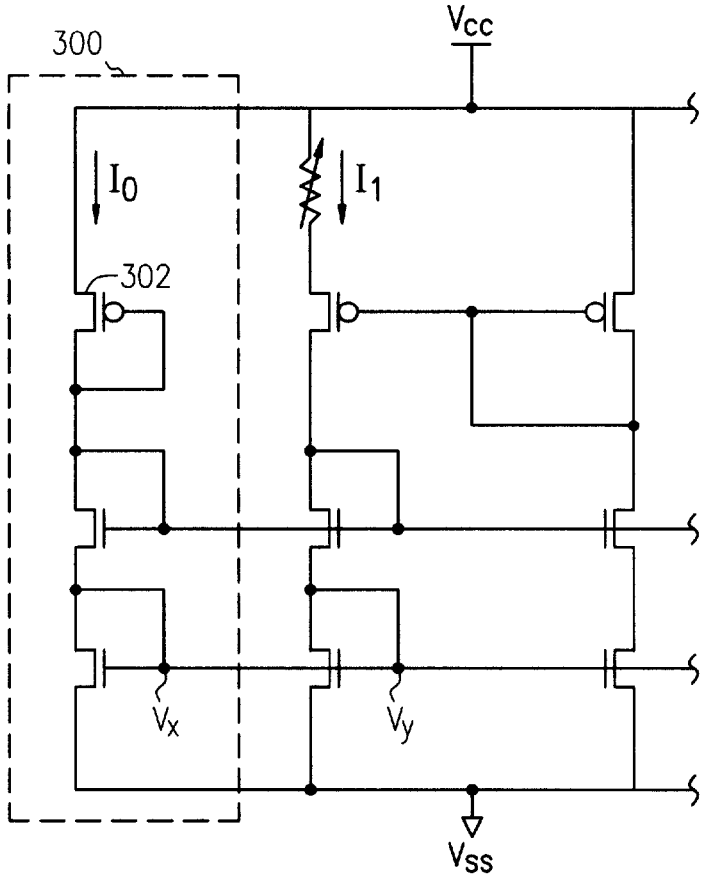
FIG. 3 is a circuit diagram of another embodiment of the present invention.

In another embodiment 300, a trim circuit for correcting for resistance changes is shown in FIG. 3. Trim circuit 300 is in one embodiment similar to limb 102 of circuit 100, without a resistance. The transistors of trim circuit 300 in this embodiment are identical to the transistors of limb 102 of circuit 100. In this embodiment, trim circuit 300 comprises P-type MOSFET 302 and NMOSFETs to generate a current I0 in the trim circuit 300. To have a reference voltage such as $V_a$, $V_b$, or $V_c$ as described above, the currents I0 and I1 should be equal. If the process of the system changes, the trim circuit 300 changes the value of R1 to make I0=I1. If the currents I0 and I1 are the same, the voltages $V_x$ and $V_y$ will be equal given that the NMOS devices carrying I0 and I1 are equal. The NMOSFETs of trim circuit 300 force current I0 in the circuit 300. With current I0 set by the NMOS devices of trim circuit 300, $V_x$ is generated. To properly trim R1, $V_x$ should equal $V_y$. Since the desired value of $V_y$ is known, R1 is changed until $V_x$=$V_y$.

At this point, the remaining resistances, whether only the circuit 100 is used, or whether additional circuitry 200 is used, are adjusted. The ratio R2/R1 is known. By the nature of the circuit topology, all resistance values R2, R3, and R4 are related to R1 linearly. Once R1 is trimmed using trim circuit 300, the values of R2, R3, and R4 are known for a given reference voltage value. If only R2 is used, the reference voltage is $V_a$. If R3 and R4 are used, the reference voltage is $V_c$ and $V_a$.

It should be understood that a trim circuit such as trim circuit 300 may be used to trim resistance for circuit 100 with or without the additional circuitry 200 without departing from the scope of the invention. It should also be understood that additional circuitry 200 may be used to scale reference voltages with or without the trim circuit 300 without departing from the scope of the invention.

Figure 4:
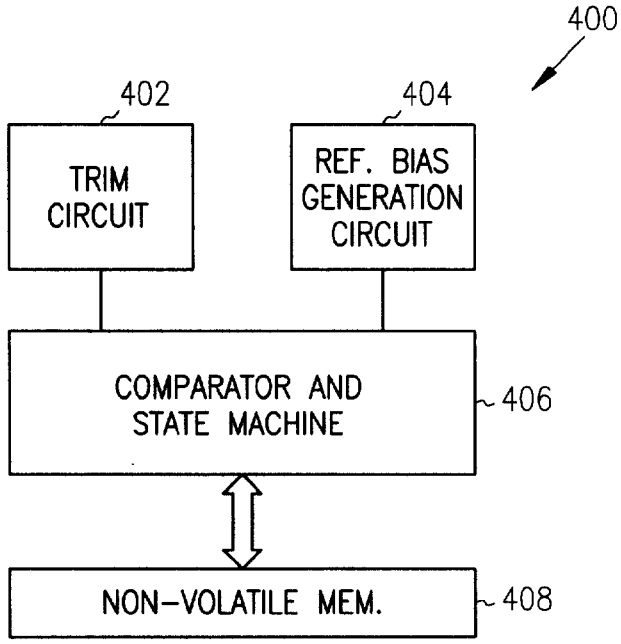
FIG. 4 is a block diagram of an apparatus embodiment of the present invention.

FIG. 4 shows an embodiment 400 of an apparatus that creates a scaled automatically trimmed MOSFET based voltage reference source. Apparatus 400 comprises in one embodiment a trim circuit 402 and a reference bias generating circuit 404 operatively connected to provide voltages to a comparator 406. The comparator 406 generates bits to enable a correct value for the trim circuit 404 to automatically trim a series of MOSFETs used as resistors as described in greater detail above with respect to FIG. 3. In one embodiment, the MOSFET transistors are binary weighted MOSFETs operating in the linear region. In one embodiment, MOS devices of different sizes which are binary factors of size W are used. For example, the devices are of sizes $2^0$W, $2^1$W, $2^2$W, et cetera. In this embodiment, to set $V_x$=$V_y$. digital bits are used to switch the resistors, and to algorithmically cycle through the entire range to stop at a point where $V_x$=$V_y$. After trimming, the bits are in one embodiment stored in a non-volatile memory 408.

In another embodiment, the comparator bits enable automatic trimming of parallel binary weighted resistors with P-type MOS switches to select the total resistor value.

Reference bias generating circuit 404 is in one embodiment a circuit such as circuit 100 described above with respect to FIG. 1. In another embodiment, the circuit 404 is a scaled reference bias generating circuit such as circuit 200 described above with respect to FIG. 2 above.

In another embodiment, the apparatus 400 is used in combination with a variety of semiconductor devices, including those on a die, such as microprocessors, digital signal processors, communication devices, or the like. Such an apparatus 400 is used in this embodiment to provide a MOSFET based temperature compensated supply voltage less than traditional supply voltages.

Figure 5:
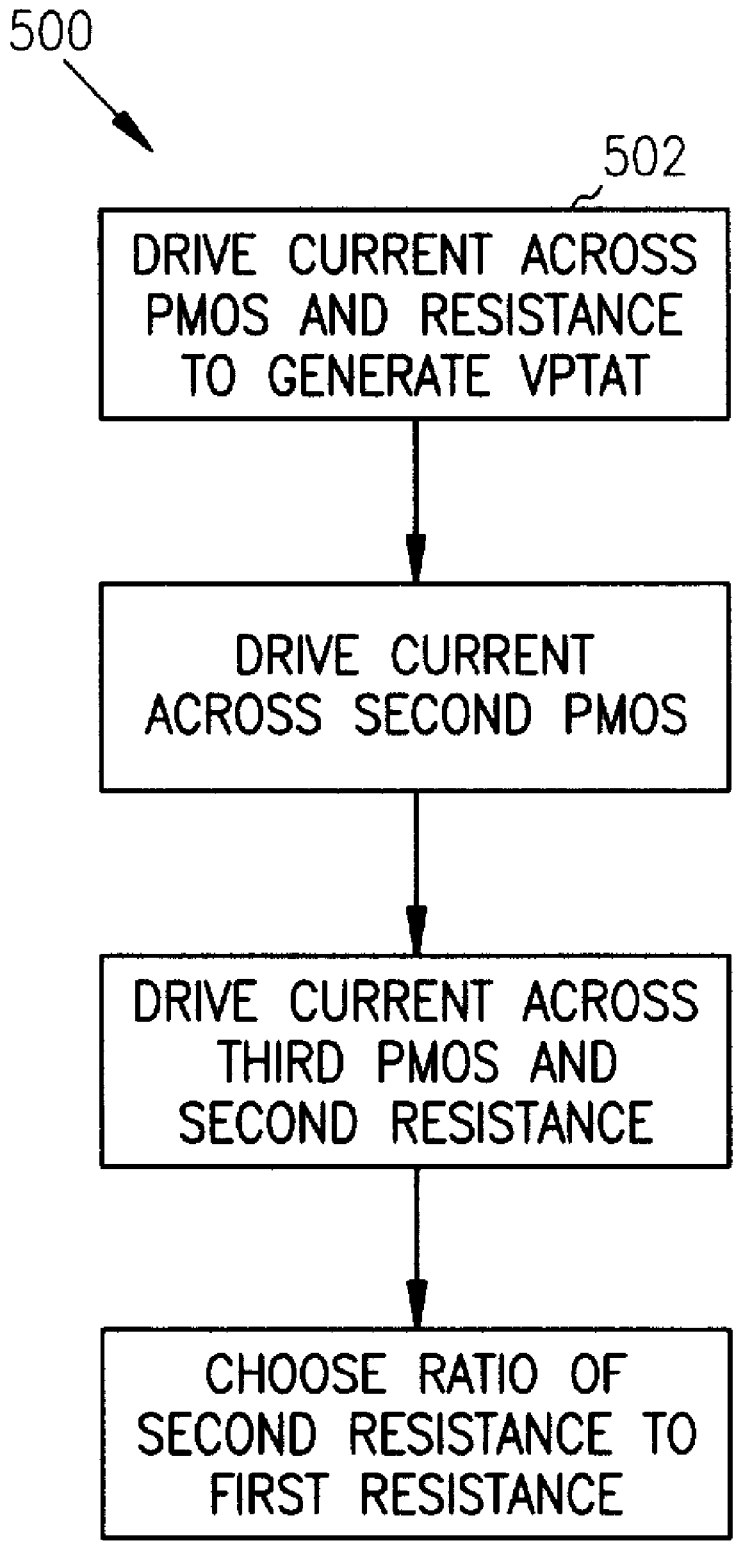
FIG. 5 is a flow chart diagram of a method embodiment of the present invention.

A method embodiment 500 for providing a temperature compensated MOSFET based reference voltage is shown in block diagram in FIG. 5. The methods described generally below have been described in greater detail above with respect to FIGS. 1, 2, 3, and 4. Method 500 comprises in one embodiment driving a current across a first PMOSFET of a first size, and a first resistance, to generate a VPTAT in block 502, driving the current across a second PMOSFET of a second size in block 504, driving the current across a third PMOSFET of the second size, and a second resistance in block 506 to generate a reference voltage, and compensating for a temperature coefficient of the third PMOSFET by choosing a ratio of the second resistance to the first resistance in block 508 to compensate the reference voltage.

In another embodiment, method 500 further comprises trimming the first resistance with a trimming circuit such as trimming circuit 300 as described above. In yet another embodiment, method 500 further comprises scaling the reference voltage with a scaling circuit such as scaling circuit 200 as described above.

The present invention provides, in various embodiments, automatic trimming of resistors to improve the accuracy of a MOSFET based reference voltage circuit, a temperature compensated MOSFET based reference voltage, and arbitrary translation of the MOSFET based reference voltage with or without trimming.

Such embodiments are useful in processor circuits where supply voltages are dropping to levels nearing the limits of BJT based bandgap reference voltage circuits. The embodiments allow scaled supply voltages, are less sensitive to process and supply voltage variations, and provide arbitrary selectable supply voltages less than typical supply voltages with PVT insensitivity, or any combination thereof.

The circuits illustrated herein are shown generating a reference voltage with respect to $V_{cc}$. However, a complementary $V_{ss}$ based reference circuit employing the methods of the present invention is well within the scope of one skilled in the art, and within the scope of the invention. Further, while MOSFETs are used to describe the methods and apparatuses of the various embodiments described above, other field effect transistors could be employed in the present invention without departing from the scope of the invention.

Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the invention. It is intended that this invention be limited only by the following claims, and the full scope of equivalents thereof.

What is claimed is:

1. A method for providing a temperature compensated FET reference voltage, comprising:

driving a first current across a first resistance and a first FET of a first size;

driving a second current across a second FET of a second size, the second current being equal to the first current;

driving a third current across a second resistance and a third FET of the second size, to generate a reference voltage across the second resistance and the third FET, wherein the third FET operates in a subthreshold region, wherein the third current is equal to the first current; and compensating for a temperature coefficient of the third FET to compensate the reference voltage such that the reference voltage is independent of temperature variation, wherein driving the first current comprises choosing a current using FETs of a different doping type than the first, second and third FETs.

2. The method of claim 1 further comprising:

scaling the compensated reference voltage.

3. The method of claim 2, wherein scaling the compensated reference voltage comprises:

scaling by a factor of a fourth resistance divided by a third resistance, wherein the third and the fourth resistances are linearly related to the first resistance.

4. The method of claim 2, wherein the scaling scales the compensated reference voltage to a voltage less than 1.23 volts.

5. The method of claim 1 further comprising:

choosing a value of the first resistance.

6. The method of claim 1 further comprising:

trimming a value of the first resistance with a trimming circuit.

7. The method of claim 6, wherein trimming further comprises:

adjusting the first resistance until a second current in a trimming circuit matches the first current.

8. The method of claim 7, wherein adjusting the first resistance further comprises:

adjusting the second resistance to maintain a constant ratio of the second resistance to the first resistance.

9. A FET based circuit, comprising:

a first limb having a first P-type FET, a first resistance, and a first current source to drive a first current through the first P-type FET;

a second limb having a second P-type FET and a second current source to drive a second current through the second P-type FET, the second limb being connected to the first limb such that the second current is equal to the first current; and a third limb having a third P-type FET, a second resistance, and a third current source to drive a third current through the third P-type FET to enable the third P-type FET to operate in a subthreshold region and to generate a reference voltage across the second resistance and the third P-type FET, the reference voltage being independent of temperature variation, the third limb being connected to the first and second limbs such that the third current is equal to the first current, wherein a value of the reference voltage is a function of the first and second resistances, wherein each of the first and second resistances comprises a binary weighted P-type FET, wherein each of the first, second, and third current sources comprises identical N-type FET devices.

10. A FET based circuit, comprising:

a first limb having a first P-type FET, a first resistance, and a first current source to drive a first current through the first P-type FET;

a second limb having a second P-type FET and a second current source to drive a second current through the second P-type FET, the second limb being connected to the first limb such that the second current is equal to the first current; and a third limb having a third P-type FET, a second resistance, and a third current source to drive a third current through the third P-type FET to enable the third P-type FET to operate in a subthreshold region and to generate a reference voltage across the second resistance and the third P-type FET, the reference voltage being independent of temperature variation, the third limb being connected to the first and second limbs such that the third current is equal to the first current, wherein a value of the reference voltage is a function of the first and second resistances, wherein each of the first and second resistances comprises a plurality of parallel binary weighted resistors actuated by a plurality of P-type MOS switches to select a total resistance value.

11. A FET based circuit, comprising:

a first limb having a first P-type FET, a first resistance, and a first current source to drive a first current through the first P-type FET;

a second limb having a second P-type FET and a second current source to drive a second current through the second P-type FET, the second limb being connected to the first limb such that the second current is equal to the first current; and a third limb having a third P-type FET, a second resistance, and a third current source to drive a third current through the third P-type FET to enable the third P-type FET to operate in a subthreshold region and to generate a reference voltage across the second resistance and the third P-type FET, the reference voltage being independent of temperature variation, the third limb being connected to the first and second limbs such that the third current is equal to the first current, wherein a value of the reference voltage is a function of the first and second resistances, wherein each of the first and second resistances comprises a binary weighted P-type FET.

12. The circuit of claim 11, wherein the size of first P-type FET is larger than the size of the second P-type FET.

13. The circuit of claim 11, wherein the size of first P-type FET is twice the size of the second P-type FET.

14. The circuit of claim 11, wherein the first and second P-type FETs operate in subthreshold region.

15. The circuit of claim 11, wherein each of the first, second and third limbs further includes a pair of N-type FETs connected in series.

16. The circuit of claim 15, wherein the sizes of N-type FETs in the first, second and third limbs are the same.

17. A FET based circuit, comprising:

a first limb including a first resistor connected to a first P-type FET, the first P-type FET connects to a first pair of N-type FETs, and a first current source to drive a first current through the first resistor and the first P-type FET;

a second limb including a second P-type FET connected a second pair of N-type FETs, and a second current source to drive a second current through the second P-type FET, the second limb being connected to the first limb such that the second current is equal to the first current; and a third limb including a second resistor connected to a third P-type FET, the third P-type FET connects to a third pair of N-type FETs, and a third current source to drive a third current through the second resistor and the second P-type FET to enable the third P-type FET to operate in a subthreshold region and to generate a reference voltage across the second resistance and the third P-type FET, the reference voltage being independent of temperature variation and a value of the reference voltage being selected by a ratio of the first and second resistors, the third limb being connected to the first and second limbs such that the third current is equal to the first current wherein each of the first and second resistances comprises a binary weighted P-type FET.

18. The circuit of claim 17, wherein each of the first, second and third limbs is connected between a supply voltage and ground.

19. The circuit of claim 18, wherein the supply voltage is greater than the reference voltage.

20. The circuit of claim 17, wherein the size of first P-type FET is larger than the size of the second P-type FET.

21. The circuit of claim 17, wherein the size of first P-type FET is twice the size of the second P-type FET.

22. The circuit of claim 17, wherein the sizes of first, second and third pairs of N-type FETs are the same.

23. The circuit of claim 17, wherein the first and second P-type FETs operate in subthreshold region.

* * * * *